United States Patent [19]

Boulton et al.

[11] 4,204,939

[45] May 27, 1980

[54] DIAPHRAGM CELL

[75] Inventors: Thomas W. Boulton; Brian J. Darwent, both of Runcorn, England

[73] Assignee: Imperial Chemical Industries Limited, London, England

[21] Appl. No.: 880,878

[22] Filed: Feb. 23, 1978

[30] Foreign Application Priority Data

Mar. 4, 1977 [GB] United Kingdom ..... 9189/77

[51] Int. Cl.[2] ..... C25B 9/00; C25B 11/03; C25B 11/10; C25B 1/16

[52] U.S. Cl. ..... 204/258; 204/266; 204/284; 204/290 F; 204/98; 204/128

[58] Field of Search ..... 204/258, 266, 263–265, 204/96, 98, 128, 290 F, 255–256, 284

[56] References Cited

U.S. PATENT DOCUMENTS

| | | | |
|---|---|---|---|
| 2,682,505 | 6/1954 | Greco | 204/284 |
| 3,864,236 | 2/1975 | Lindstrom | 204/258 X |
| 3,941,675 | 3/1976 | Strasser et al. | 204/256 |
| 4,069,129 | 1/1978 | Sato et al. | 204/258 |
| 4,076,609 | 2/1978 | Mas | 204/258 |
| 4,124,478 | 11/1978 | Tsien et al. | 204/255 |

*Primary Examiner*—John H. Mack
*Assistant Examiner*—D. R. Valentine
*Attorney, Agent, or Firm*—Cushman, Darby & Cushman

[57] ABSTRACT

A monopolar filter press electrolytic cell for use in the electrolysis of alkali metal halide brine to produce cell liquor, halogen and hydrogen the cell comprising a plurality of anode plates and cathode plates and a hydraulically permeable diaphragm positioned between each adjacent anode plate and cathode plate, and comprising at least one spacing plate of a non-conducting material positioned between each anode plate and adjacent diaphragm and between each cathode plate and adjacent diaphragm, the anode plates, cathode plates and spacing plates being provided with at least two openings in the faces of the plates which in combination define a first compartment lengthwise of the cell separated from the second compartment, the spacing plates between the anode and adjacent diaphragm being provided with at least one passage which permits brine to pass between the first compartment and the anolyte compartments and which permits halogen to be released from the anolyte compartments to the first compartment, and the spacing plates between the cathodes and adjacent diaphragms being provided with at least one passage which permits cell liquor and hydrogen to pass from the catholyte compartments to the second compartment, the anode plates and cathodes plates being made in part of a non-conducting material so that the first and second compartments are electrically insulated from one another.

35 Claims, 4 Drawing Figures

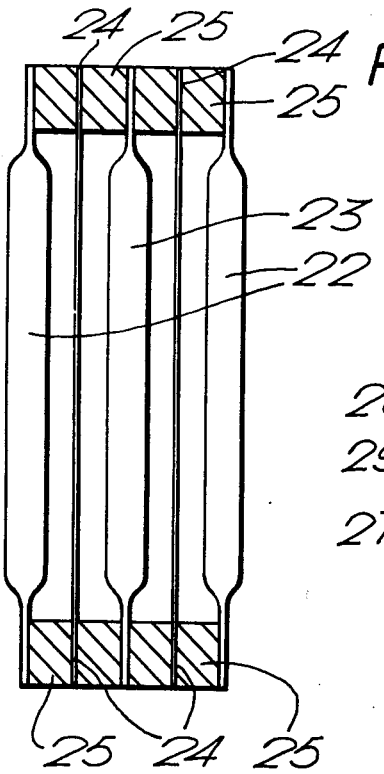
Fig.3.
Fig.4.
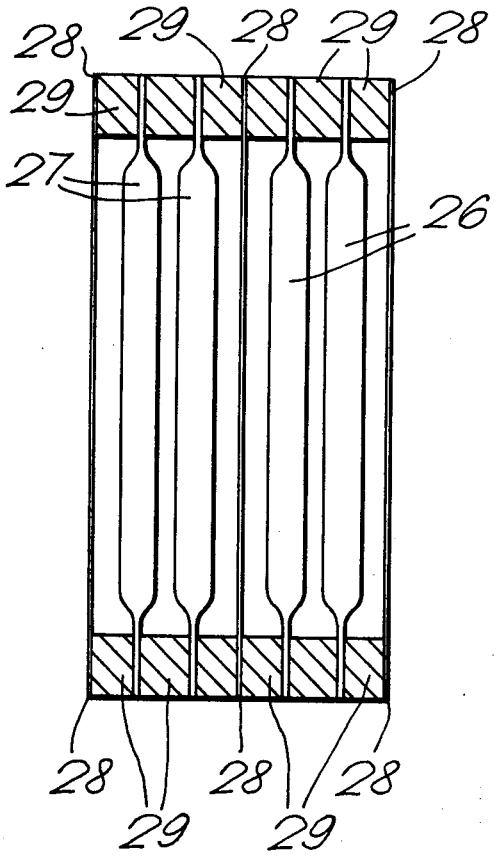

DIAPHRAGM CELL

This invention relates to an electrolytic diaphragm cell, particularly to an electrolytic diaphragm cell of the filter press type.

A wide variety of diaphragm cells are known which consist in principle of a plurality of anodes and a plurality of cathodes disposed in a parallel alternating manner and separated from each other by substantially vertical diaphragms. The anodes are suitably in the form of plates of a film-forming metal (usually titanium) and carry an electrocatalytically active coating (for example a platinum group metal oxide); the cathodes are suitably in the form of a perforated plate or gauze of metal (usually mild steel); and the diaphragms, which may be deposited on to the surface of the cathodes, are suitably made of asbestos or a mixture of asbestos and a fluoropolymeric material, for example polytetrafluoroethylene or polyvinylidene fluoride. Alternatively, the diaphragms may be in the form of sheets, for example of asbestos or of fluoropolymeric materials, which are fitted onto the surface of the cathodes.

Diaphragm cells containing deposited diaphragms are usually of the tank type monopolar design. Such cells are not suited to the use of sheet diaphragms because of the problems involved in cladding the complex cathode shapes which are used. Accordingly, filter press or "sandwich" type cell designs have been developed to accommodate diaphragm sheets. However such filter press cells are invariably more expensive than monopolar tank-type cells in respect of capital costs because of the relative complexity of their construction and because of the need to build in current distributors to reduce voltage drop in the anode/cathode module sizes conventionally considered.

We have now devised a monopolar filter press cell which is suitably for use with sheet diaphragms and which is readily made, inexpensive and easily assembled.

According to the present invention we provide a monopolar filter press electrolytic cell suitable for use in the electrolysis of aqueous alkali metal halide solution (hereinafter referred to as brine) to produce an aqueous alkali metal hydroxide solution (hereinafter referred to as cell liquor), halogen and hydrogen, which cell comprises a plurality of anode plates and cathode plates, a hydraulically permeable diaphragm positioned between each adjacent anode plate and cathode plate, the anode plates comprising an anode portion of a film-forming metal which carries an electrocatalytically active coating, the cathode plates comprising a metallic cathode portion, and the cell comprising at least one spacing plate of a non-conducting material positioned between each anode plate and adjacent diaphragm and between each cathode plate and adjacent diaphragm, the anode plates, cathode plates and spacing plates being provided with at least two openings in the faces of the plates which, when the said plates are assembled in a filter press cell, define in combination a first compartment lengthwise of the cell and a second compartment lengthwise of the cell separated from the first compartment, the said compartments in the filter press cell being located above the anolyte and catholyte compartments of the cell defined respectively by the spaces between the anodes and diaphragms and the spaces between the cathodes and diaphragms, the the spacing plates between the anodes and adjacent diaphragms being provided with at least one passage which permits brine to pass between the first compartment and the anolyte compartments and which permits halogen to be released from the anolyte compartments to the first compartment, and the spacing plates between the cathodes and adjacent diaphragms being provided with at least one passage which permits cell liquor and hydrogen to pass from the catholyte compartments to the second compartment, the cell being provided with end plates which provide end walls for the aforementioned first and second compartments, and the anode plates and cathode plates being made in part of a non-conducting material so that the first and second compartments are electrically insulated from one another.

The hydraulically permeable diaphragms may be attached to diaphragm plates comprising at least two openings in the faces of the plates which, in the cell, define a part of the first and second compartments respectively. The diaphragm plates should be made of a non-conducting material.

The openings in the anode, cathode and spacing plates may be defined by frame portions.

The end plates of the cell preferably comprise a terminal anode plate and a terminal cathode plate which do not necessarily comprise in part a non-conducting material. Thus, the terminal anode plate may be made of a film-forming metal which carries an electrocatalytically active coating on a part of its surface, and the terminal cathode plate may be metallic.

The film-forming metal comprising the anode portion of the anode plate, or the terminal anode, preferably is one of the metals titanium, zirconium, niobium, tantalum or tungsten or an alloy consisting principally of one or more of these metals and having anodic polarisation properties which are comparable with those of the pure metal. It is preferred to use titanium alone, or an alloy based on titanium and having polarisation properties comparable with those of titanium. Examples of such alloys are titanium-zirconium alloys containing up to 14% of zirconium, alloys of titanium with up to 5% of a platinum group metal, for example an alloy of titanium with platinum, rhodium or iridium, and alloys of titanium with niobium or tantalum containing up to 10% of the alloying constituent.

The anode portion of the anode plate may be in the form of a perforated plate or gauze but is preferably in the form of louvres. The louvres are conveniently produced from a sheet of film-forming metal by pressing with a slitting and forming tool. The louvre slats so obtained may suitably be turned at right angles to the original plane of the film-forming metal sheet, or they may be inclined to this plane if desired. The louvred slats are preferably inclined at an angle of more than 60° to the plane of the anode sheet.

The louvres of each anode plate when installed in the cell are preferably aligned so that their longitudinal axes are parallel to one another and are inclined at an angle to the vertical e.g. at an angle of about 45°, so as to direct the halogen produced in anolyte compartments towards the first compartment disposed lengthwise of the cell.

The electrocatalytically active coating is a conductive coating which is resistant to electrochemical attack but is active in transferring electrons between electrolyte and the anode.

The electrocatalytically active coating may suitably consist of one or more platinum group metals, i.e. platinum, rhodium, iridium, ruthenium, osmium and palladium, and alloys of the said metals, and/or the oxides thereof, or another metal or a compound which will function as an anode and which is resistant to electrochemical dissolution in the cell, for instance rhenium, rhenium trioxide, magnetite, titanium nitride and the borides phosphides and silicides of the platinum group metal. The coating may consist of one or more of the said platinum group metals and/or oxides thereof in admixture with one or more non-noble metal oxides. Alternatively, it may consist of one or more non-noble metal oxides alone or a mixture of one or more non-noble metal oxides and a non-noble metal chlorine discharge catalyst. Suitable non-noble metal oxides are, for example, oxides of the film-forming metals (titanium zirconium, niobium, tantalum or tungsten), tin dioxide, germanium dioxide and oxides of antimony. Suitable chlorine-discharge catalysts include the difluorides of manganese, iron, cobalt, nickel and mixtures thereof.

Especially suitable electrocatalytically active coatings according to the invention include platinum itself and those based on ruthenium dioxide/titanium dioxide and ruthenium dioxide/tin dioxide/titanium dioxide.

Other suitable coatings include those described in our UK Pat. Nos. 1402414 and 1484015 in which a non-conducting particulate or fibrous refractory material is embedded in a matrix of electrocatalytically active material (of the type described above). Suitable non-conducting particulate or fibrous materials include oxides, carbides, fluorides, nitrides and sulphides. Suitable oxides (including complex oxides) include zirconia, alumina, silica, thorium oxide, titanium dioxide, ceric oxide, hafnium oxide, ditantalum pentoxide, magnesium aluminate (e.g. spinel $MgO.Al_2O_3$), aluminosilicates (e.g. mullite $(Al_2O_3)$ $(SiO_2)_2$), zirconium silicate, glass, calcium silicate (e.g. bellite $(CaO)_2SiO_2$), calcium aluminate, calcium titanate (e.g. perovskite $CaTiO_3$), attapulgite, kaolinite, asbestos, mica, codierite and bentonite; suitable sulphides include dicerium trisulphide, suitable nitrides include boron nitride and silicon nitride; and suitable fluorides include calcium fluoride. A preferred non-conducting refractory material is a mixture of zirconium silicate and zirconia, for example zirconium silicate particles and zirconia fibres.

The anode portions of the anode plates may be prepared by a painting and firing technique, wherein a coating of metal and/or metal oxide is formed on the anode surface by applying to the surface of the anode plate a layer of a paint composition comprising a liquid vehicle containing thermally-decomposable compounds of each of the metals that are to feature in the finished coating, drying the paint layer by evaporating the liquid vehicle, and then firing the paint layer by heating the coated anode plate, suitably at 250° C. to 800° C., to decompose the metal compounds of the paint and form the desired coating. When refractory particles or fibres are to be embedded in the metal and/or metal oxide of the coating, the refractory particles or fibres may be mixed into the aforesaid paint composition before it is applied to the anode plate. Alternatively, the refractory particles or fibres may be applied on to a layer of the aforesaid paint composition while this is still in the fluid state on the surface of the anode plate, the paint layer then being dried by evaporation of the liquid vehicle and fired in the usual manner.

The electrocatalytically active coatings are preferably built up by applying a plurality of paint layers on the anode plate, each layer being dried and fired before applying the next layer.

The metal comprising the cathode portion of the cathode plates is generally of iron or steel, preferably of mild steel, but other metals may be used, for example nickel.

The metallic cathode portion may consist of a perforated plate or gauze, but is preferably in the form of louvres. The louvres may be produced from a metal sheet, for example of mild steel or iron, by pressing with a slitting and forming tool as described above with reference to anode plates.

The cathode louvres are preferably inclined at an angle of more than 60° to the plane of the cathode sheet.

The louvres of each cathode plate when installed in the cell are preferably aligned so that their longitudinal axes are parallel to one another and are inclined at an angle to the vertical, e.g. at an angle of about 45°, so as to direct the hydrogen produced in catholyte compartments towards the second common compartment disposed lengthwise of the cell.

In a preferred embodiment, both the anode and the cathode louvres are inclined with their longitudinal axes at 45° to the vertical (as defined above), i.e. successive anodes and cathodes have louvres whose longitudinal axes are inclined at 90° with respect to one another.

The anode plates and cathode plates must be made in part of a non-conducting material so that the first and second compartments disposed lengthwise of the cell are electrically insulated from one another. Thus that part of the anode plate having an opening which in the cell defines a part of the first compartment may be made of a metal, e.g. the film-forming metal of the anode portion of the plate, in which case that part of the anode plate having an opening which in the cell defines a part of the second compartment should be made up of a non-conducting material, for example a plastics material, e.g. polypropylene. Conversely, that part of the cathode plate having an opening which in the cell defines a part of the first compartment should be made of a non-conducting material, for example a plastics material, e.g. polypropylene, and that part of the cathode plate having an opening which in the cell defines a part of the second compartment may be made of a metal, e.g. the same metal as that of the cathode portion of the cathode plate. Alternatively, that part of the anode plate having an opening which in the cell defines a part of the first compartment may be made of a non-conducting material, and that part having an opening in the cell defines a part of the second compartment may be made of a metal, and conversely that part of the cathode plate having an opening which in the cell defines a part of the first compartment may be made of a metal or that part having an opening which in the cell defines a part of the second compartment may be made of a non-conducting material. The parts of the anode plates and cathode plates which define the openings in the plates may be in the form of frame portions made of appropriate materials as hereinbefore described.

In preferred anode plates and cathodes plates the plates are in two parts, a metallic part and a part made of a non-conducting material, and the parts of the anode plates are placed next to each other, and the parts of the cathode plates are placed near to each other, during assembly of the filter press cell.

The anode portion of the anode plate, the cathode portion of the cathode plate, and the diaphragm are conveniently of substantially the same shape. For example, the anode portions, cathode portions and diaphragms may be in the shape of a square or a rhombus, or may be rectangular, or circular. The preferred shape is a square shape arranged so that the diagonals of the square are horizontal and vertical. Preferably the anode plate, cathode plate and diaphragm plate are symmetrical about a vertical axis.

It is also preferred that the openings in the plates which in the cell define the first compartment are of substantially the same shape so that the first compartment is of uniform cross-section throughout its length. Similarly, it is preferred that the openings in the plates which in the cell define the second compartment are of substantially the same shape so that the second compartment is of uniform cross-section throughout its length. Preferably, both sets of openings are of substantially the same shape.

The anode plate, cathode plates, spacing plates, and diaphragm plates, are preferably flexible. The aforesaid plates can readily be made flat and of a uniform thickness and may be made sufficiently thin so as to be flexible. This flexibility enables a uniform and adequate pressure to be maintained in all jointing areas in the cell, thereby preventing leakage.

The spacing plates are conveniently of the same size and shape as the anode, cathode and diaphragm plates.

The spacing plates, in addition to being provided with two openings in the faces of the plates which in the cell form respectively a part of the first and second compartments, are further provided with an opening in the face of the plate which in the cell, defines a part of each anolyte or catholyte compartment.

The passages of each spacing plate are conveniently in the form of a plurality of slots cut within the thickness of the plates between either the openings corresponding to the anolyte compartments and the first compartment or the openings between the catholyte compartments and the second compartment.

Passages conveniently in the form of a plurality of slots are cut within the thickness of the face plate between the openings corresponding to the anolyte compartments and the first compartment or between the openings corresponding to the catholyte compartments and the second compartment. Alternatively a separate slotted or formed spacer piece may be provided. On assembling the spacing plates into the cell the plates provide the passages connecting (1) the anolyte compartments and the first compartment and (2) the catholyte compartments and the second compartment respectively.

The spacing plates may be fabricated in any suitable non-conducting material, but it is preferred to use synthetic organic polymers which are inert to the conditions prevailing in the cell. Especially suitable polymers include polyvinylidene fluoride and polypropylene. The spacing plates are conveniently cut from a sheet of the polymer or moulded from the polymer.

The cell may conveniently be provided with sealing joints or gaskets which are suitably of an elastomeric material, for example of natural or synthetic rubber. The sealing joints or gaskets are suitably cut from a sheet of the elastomeric material or moulded from the elastomeric material and correspond in overall size and shape to the aforesaid spacing plates.

Alternatively, the spacing plates may be modified in shape and thickness to act as both spacers and as sealing joints or gaskets. In this case, the combined spacing plates and gaskets are conveniently made of an elastomeric material, for example natural or synthetic rubber, and the aforesaid passages in the spacing plates are provided for by incorporating a spring device which is either a pressing made of the anode or cathode material, or a flexible moulding in a suitable polymer. The spring device would allow the flow of gas or liquor with the minimum of obstruction and would have a resiliency and depth compatible with the elastomer so that jointing pressure is transmitted.

The sealing joints or gaskets, or spacing plates which act as sealing joints or gaskets, are sufficiently thin and flexible to promote good jointing conditions in the cell, especially when the anode plates, cathode plates, diaphragm plates and the spacing plates (if present) are flexible.

Any suitable diaphragm material may be used, but it is preferred to use porous fluoropolymer (e.g. polytetrafluoroethylene) diaphragms. Suitable diaphragms may be prepared from aqueous dispersions of polytetrafluoroethylene and removable filler by the methods described in our UK Pat. Nos. 1081046 and 1424804. The filler may be removed prior to introducing the diaphragm into the cell, for example by treatment with acid to dissolve the filler. Alternatively the filler may be removed from the diaphragm in situ in the cell, for example as described in our UK Pat. No. 1468355 in which acid containing a corrosion inhibitor is used to dissolve the filler, or the filler is removed electrolytically.

Alternatively, the diaphragm may be formed from sheets of porous polymeric material containing units derived from tetrafluoroethylene, said material having a micro-structure characterised by nodes interconnected by fibrils. The aforesaid polymeric material and its preparation are described in UK Pat. No. 1355373, and its use as a diaphragm in electrochemical cells is described in our copending UK Applications Nos. 23275/74 and 23316/74 (Belgian Patent Specification 829388).

The diaphragm may also be formed by an electrostatic spinning process. Such a process is described in our copending UK Application No. 41873/74 and involves introducing a spinning liquid comprising liquid comprising an organic fibre-forming polymer material (for example a fluorinated polymer, e.g. polytetrafluoroethylene) into an electric field whereby fibres are drawn from the liquid to an electrode and collecting the fibres so produced upon the electrode in the form of a porous sheet product.

In one arrangement of the cell, single anode plates alternate with single cathode plates, with diaphragm plates interposed between adjacent anode and cathode plates. In an alternative arrangement, pairs of anode plates alternate with pairs of cathode plates, with diaphragm plates interposed between adjacent pairs of anode plates and pairs of cathode plates.

The use of pairs of anode and cathode plates, instead of single plates provides increased gas disengagement space in the vicinity of the anode and cathodes.

The anode portion of each anode plate and the cathode portion of each cathode plate preferably has a dimension in the direction of current flow which is in the range 15 to 60 cm, particularly in the range 15 to 25 cm when using alternating single anode and cathode plates, and in the range 30 to 50 cm when using alternating pairs of anode and cathode plates. The aforesaid preferred dimensions of the anode and cathode portions provide short current paths which in turn ensure low voltage drops in the anodes and cathodes without the use of elaborate current carrying devices.

The distance between successive diaphragm surfaces defining a cell module is preferably in the range 5 to 20 mm, for example in the range 5 to 8 mm when using alternating single anodes and cathodes, and in the range 10 to 20 mm when using alternating pairs of anodes and cathodes.

In operation, the brine passes downwards from the overhead inlet feed brine compartment through passages in spacing plates into the anolyte compartments.

Halogen gas generated in the anolyte compartments passes upwards through the brine feed passages and disengages in the overhead common inlet feed brine compartment. The brine percolates through the diaphragms into the catholyte compartments, where cell liquor and hydrogen are produced. The cell liquor and hydrogen rise through the passages in the spacing plates into the other overhead compartment where hydrogen disengages.

The cell according to the present invention is therefore built up of formed or pressed anode and cathode plates of similar shape, separated by shaped moulded or cut-out spacing plates of a suitable non-conducting material, together with the necessary sealing joints or gaskets. The cell is conveniently provided with end plates, adjacent respectively to the terminal anode and cathode plates. The end plates are suitably of mild steel, suitably protected from the cell environment e.g. by means of a plastics spacer, and the whole assembly may be clamped together, for example by bolting the end plates. This simple design advantageously allows a commercial cell to be constructed at a relatively low capital cost as compared with conventional monopolar tank-type cells or bipolar filter press cells.

When using this flexible anode plates and cathode plates, it is not necessary for the plates to be made preferably plane during manufacture since the plates become flattened whilst assembling because of the pressure exerted by the end plates which may be of comparatively massive construction. Moreover, the use of this anode and cathode plates (e.g. 1 mm thickness) results in the louvres formed in the active portions of the anode and the cathode having little strength so that they are easily deflected by the diaphragm of they come into contact with it during assembling, whereby avoiding damage to the diaphragm. In this way, a relatively small anode/cathode gap, for example 2 mm, can simply and effectively be achieved.

The overall length of the cell will inevitably be greater than the thickness of the individual modules. It is envisaged, for example, that current connection to the modules of a cell will be by means of a plurality of flexible current connectors equal in number to the number of cell modules in the cell.

A plant for the production of halogen and alkali metal hydroxide solution may comprise a plurality of cells of the present invention, and the cells may be connected to one another by means of tie rods or clamps passing through or around the assembly of flexible connectors and the anode and cathode plates as appropriate. Where such a plurality of cells are used and a particular cell has to be taken out of operation, that is electrically isolated, a jumper switch may be positioned directly above the cell to be removed from operation and connections may be made to appropriate points along the whole length of the inter cell connectors by means of a similar tie rod or clamp arrangement. The cell may then be removed either from beneath or from the side. Alternatively, the jumper switch may be placed beneath the cell and the cell removed from above.

The invention is especially applicable to diaphragm cells used for the manufacture of chlorine and sodium hydroxide by electrolysis of aqueous sodium chloride solutions.

By way of example, an embodiment of the invention will now be described with reference to the accompanying drawings in which:

FIG. 2 is cut away to display successive components of the cell.

FIG. 3 is a diagrammatic sketch of a cell according to the invention comprising single anode plates alternating with single cathode plates. FIG. 4 is a diagrammatic sketch of a cell according to the invention comprising pairs of anode plates alternating with pairs of cathode plates.

Figure 1:
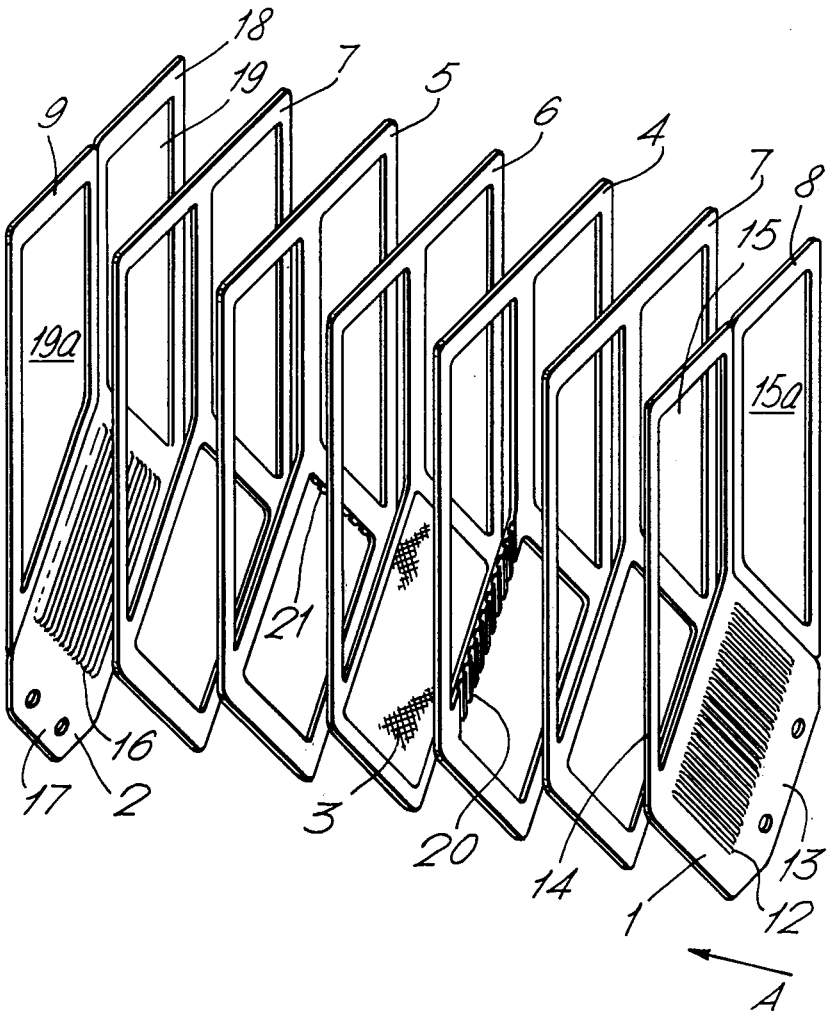
FIG. 1 is a perspective expanded view of part of a diaphragm cell according to the invention.

The part of the cell illustrated comprises anode plate 1, cathode plate 2 and diaphragm 3 in combination with spacing plates 4,5, and diaphragm plate 6, and gaskets 7.

The diaphragm 3 and associated plate 6 separates an anolyte module comprising an anode plate 1, a spacing plate 4, and gasket 7, from a catholyte module comprising a cathode plate 2 spacing plate 5, and gasket 7. The cell in FIG. 1 contains half an anode module and half a cathode module, but it will be appreciated that a commercial cell would contain a plurality of such anode and cathode modules, typically 500 to 2000 modules. The plurality of modules would be clamped together (with provision for heat expansion) by means of bolts and springs, of hydraulic devices.

The cell would further comprise end plates (not shown), suitably of mild steel.

The individual components of the cell referred to above (and which are discussed in detail below) combine to define a compartment 10 (shown in FIG. 2) for inlet feed brine and chlorine product and which extends along the length of the cell, a compartment 11 (shown in FIG. 2) for alkali metal hydroxide solution product (cell liquor) and hydrogen product which also extends along the length of the cell, and alternate anolyte and catholyte compartments (one associated with each module) extending between successive diaphragms 3. The dimensions of the anolyte and catholyte compartments are determined by the distance between successive diaphragm 3 and anode plate 1 and cathode plate 2 respectively, and by the cross-section of the associated active anode portions (and active cathode portions) as discussed below.

Each anode plate 1 consists of an active portion 12 and a frame portion 14 which is suitably fabricated of a film-forming metal, preferably titanium, and a frame portion 8 suitably fabricated of a plastics material, e.g. polypropylene. The active anode portion 12 in the form of a plurality of louvres carrying an electrocatalytically active coating (for example, a mixture of ruthenium oxide and titanium dioxide). The anode plate 1 has an extended portion 13 for connecting to a source (not shown) of electric current, and the frame portions 14 and 8 define openings 15 and 15*a* the dimensions of which correspond to the cross-sections of the compartments 10 and 11 respectively.

Each cathode plate 2 consists of an active portion 16 and a frame portion 18 which is suitably fabricated of mild steel or iron, preferably mild steel, and a frame portion 9 suitably fabricated of a plastics material, e.g. polypropylene. The active cathode area 16 is in the form of a plurality of louvres. The cathode plate 2 has an extended portion 17 for leading away the electric current, and the frame portions 18 and 9 define openings 19 and 19*a* respectively the dimensions of which correspond to the cross-sections of the compartment 11 and 10 respectively.

Each diaphragm 3 is suitably a microporous sheet of asbestos or of a fluorinated polymer, and is preferably a microporous sheet of polytetrafluoroethylene. The diaphragm 3 is supported on a plate 6 fabricated from any suitable elastomeric material, for example natural or synthetic rubber.

The plate 6 is in the form of a frame defining three openings, the dimensions of which correspond respectively to the cross-sections of the anolyte or catholyte compartments, and the common compartments 10 and 11.

Each spacing plate 4,5 is suitably fabricated of a plastics material, for example polypropylene. The spacing plates 4,5 are provided with three openings the dimensions of which are substantially the same as the dimensions of the openings in the diaphragm plates 6. The spacing plates 4,5 are further provided with slots 20,21 respectively positioned in the cell so that the slots 20 of spacing plate 4 connect an anolyte compartment and the compartment 10 and the slots 21 of spacing plate 5 connect a catholyte compartment and the common compartment 11.

Each of the gaskets 7 is fabricated from an elastomeric material, for example natural or synthetic rubber. The gasket 7 is in the form of a frame defining three openings, the dimensions of which correspond approximately to the cross-sections of the anolyte or catholyte compartments, and the compartments 10 and 11. Plate 6 and plates 4 and 5 are similar in overall shape except that plate 6 has a lower opening smaller than the corresponding opening in plates 4 and 5, so that in the cell the edges of the diaphragm 3, which is slightly large than the lower opening in plate 6, are trapped between plate 6 and plate 4 or plate 5. Furthermore, plates 6 are conveniently of a thickness compatible with the thickness of the diaphragm whereas gaskets 7 are suitably of thinner material.

The cell is suitably provided with an inlet conduit (not shown) for sodium chloride brine (connected to the compartment 10), and outlet conduits (not shown) for chlorine (connected to the compartment 10,) and for hydrogen and cell liquor (connected to the compartment 11).

In operation, sodium chloride brine passes downwards from compartment 10 through slots 20 in spacing plates 4 into the anolyte compartments. Chlorine gas generated in the anolyte compartments passes upwards through slots 20 of spacing plates 4 and disengages in the compartment 10. Cell liquor and hydrogen produced in the catholyte compartments rises through slots 21 in spacing plates 5 into the common compartment 11 where the hydrogen disengages.

Figure 2:
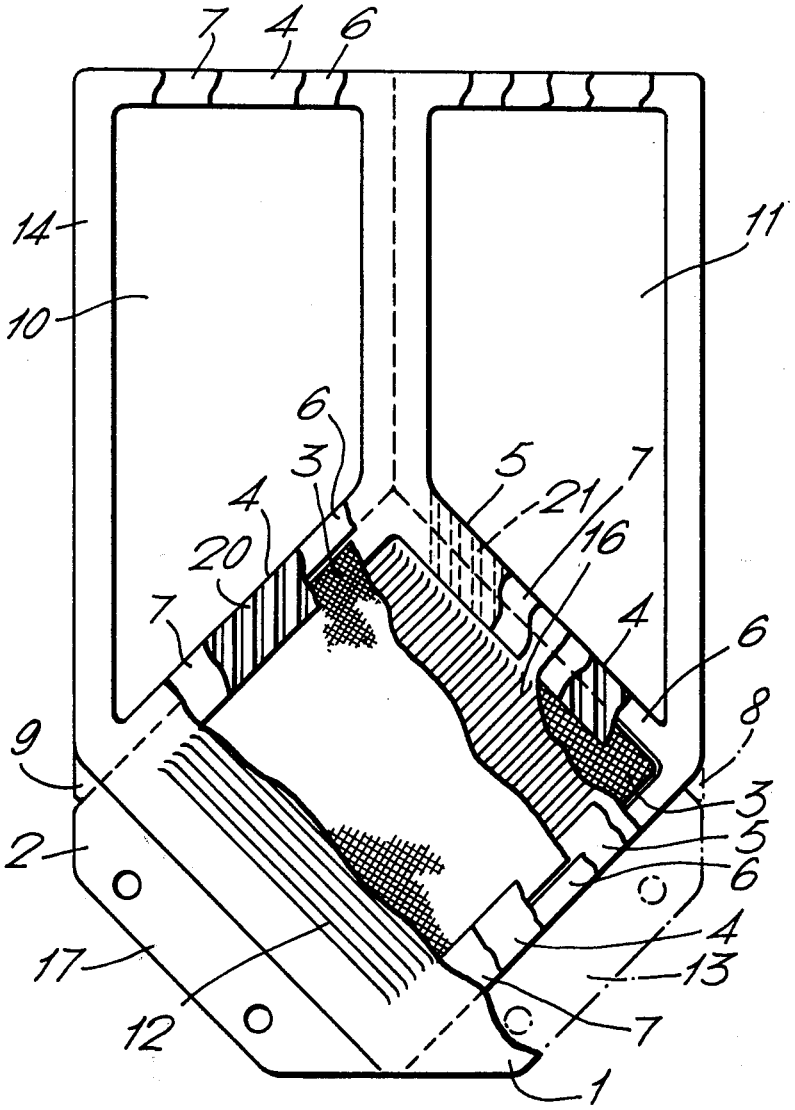
FIG. 2 is a diagrammatic end view of the part of the diaphragm cell of FIG. 1 viewed in the direction A.

Referring to FIG. 3, the cell of the type shown in FIGS. 1 and 2 is shown diagrammatically to illustrate the arrangement of single anode plates 22 (corresponding to anode plates 1) alternating with single cathode plates 23 (corresponding to cathode plates 2), with diaphragms 24 interposed between the anode plates 22 and cathode plates 23. FIG. 3 also shows the gaskets 25 (corresponding to gaskets 7) but, for simplicity, the spacing plates (shown as 4 in FIGS. 1 and 2) are not represented.

Referring to FIG. 4, a cell is shown diagrammatically to illustrate the alternative arrangement of alternating pairs of anode plates 26 and pairs of cathode plates 27, in combination with diaphragms 28 and gaskets 29.

The cell according to the invention is further illustrated by the following Example:

EXAMPLE

A diaphragm cell according to the invention was provided with four titanium louvred anode plates 1 (each 0.75 mm thickness) coated with a mixture of ruthenium oxide and titanium dioxide, four mild steel louvred cathode plates 2 (each 0.75 mm thickness), and seven electrostatically spun polytetrafluoroethylene sheet diaphragms (3 mm thickness). The length of the louvres of the anode and cathode plates which follow the direction of current flow was 15 cm. The distance between diaphragm surfaces in the anolyte (or catholyte) compartments was 6 mm. The spacing plates 4 and frames 7, 8 were fabricated in polypropylene and the diaphragm plates 6 were fabricated in synthetic rubber.

The cell was fed with sodium chloride brine 300 g/liter NaCl) at a rate of 5 liters/hour, and a current of 480 amps (corresponding to a current density of 3 $kA/m^2$) was passed through the cell. The cell operating voltage was 3.5 volts. The chlorine produced contained 95% by weight of $Cl_2$ and 5% by weight of $O_2$. The sodium hydroxide produced contained 10% by weight of NaOH. The cell operated at a current efficiency of 86%.

What we claim is:

1. A monopolar filter press electrolytic cell suitable for use in the electrolysis of aqueous alkali metal halide solution (hereinafter referred to as brine) to produce an aqueous alkali metal hydroxide solution (hereinafter referred to as cell liquor), halogen and hydrogen, which cell comprises a plurality of anode plates and cathode plates, and a hydraulically permeable diaphragm positioned between each adjacent anode plate and cathode plate, the anode plates comprising an anode portion of a film-forming metal which carries an electrocatalytically active coating, the cathode plates comprising a metallic cathode portion, characterised in that the cell comprises at least one spacing plate of a non-conducting material positioned between each anode plate and adjacent diaphragm and between each cathode plate and adjacent diaphragm, the anode plates, cathode plates and spacing plates being provided with at least two openings in the faces of the plates which, when the said plates are assembled into a filter press cell, define in combination a first compartment lengthwise of the cell and a second compartment lengthwise of the cell separated from the first compartment, the said compartments in the filter press cell being located above the anolyte and catholyte compartments of the cell defined respectively by the spaces between the anodes and diaphragms and the spaces between the cathodes and diaphragms, the anode portion of the anode plate and the cathode portion of the cathode plate and the diaphragm being of substantially the same shape and being of circular shape or of square or rhombus shape with the diagonals of the square or rhombus being substantially horizontal or vertical, the spacing plates between the anodes and adjacent diaphragms being provided with at least one passage which permits brine to pass between the first compartment and the anolyte compartments and which permits halogen to be released from the anolyte compartments to the first compartment, and the spacing plates between the cathodes and adjacent diaphragms being provided with at least one passage which permits cell liquor and hydrogen to pass from the catholyte compartments to the second compartment, the cell being provided with end plates which provide end walls for the aforementioned first and second compartments, the anode plates and cathode plates being made in part of a non-conducting material so that the first and second compartments are electrically insulated from one another.

2. A cell as claimed in claim 1 characterised in that the diaphragm is attached to a diaphragm plate comprising at least two openings in the faces of the plate which in the cell define a part of the first and second compartments respectively.

3. A cell as claimed in claim 2 characterised in that the openings in the anode, cathode spacing and diaphragm plates are defined by frame portions.

4. A cell as claimed in claim 1 wherein the end plates comprise a terminal anode plate and a terminal cathode plate.

5. A cell as claimed in claim 1 wherein the anode, cathode, spacing and diaphragm plates are flexible.

6. A cell as claimed in claim 1 wherein the electrocatalytically active coating comprises a mixture of a platinum group metal oxide and a film-forming metal oxide.

7. A cell as claimed in claim 6 wherein the coating comprises a mixture of ruthenium oxide and titanium dioxide.

8. A cell as claimed in claim 3 claims wherein the frame portion of each anode plate defining an opening corresponding to a part of the first compartment is made of a film-forming metal and is integral with the anode portion.

9. A cell as claimed in claim 8 characterised in that the integral anode and frame portions are pressed from a single sheet of a film-forming metal.

10. A cell as claimed in claim 9 characterised in that the film-forming metal is titanium.

11. A cell as claimed in claim 3 wherein the frame portion of each anode plate defining an opening corresponding to a part of the second compartment is made of a non-conducting material and is separate from the remainder of the anode plate.

12. A cell as claimed in claim 11 characterised in that the non-conducting material is polypropylene.

13. A cell as claimed in claim 3 wherein the frame portion of each cathode plate defining an opening corresponding to a part of the second compartment is made of the same metal of the metallic portion and is integral with the metallic portion.

14. A cell as claimed in claim 13 characterised in that the integral cathode and frame portions are pressed from a single sheet of metal.

15. A cell as claimed in claim 14 characterised in that the metal is mild steel.

16. A cell as claimed in claim 3 wherein the frame portion of each cathode plate defining an opening corresponding to a part of the first compartment is made of a non-conducting material and is separate from the remainder of the cathode plate.

17. A cell as claimed in claim 16 characterised in that the non-conducting material is polypropylene.

18. A cell as claimed in claim 1 wherein the anode portions, the cathode portions and the diaphragms are of a substantially square shape arranged so that the diagonals of the square are horizontal and vertical.

19. A cell as claimed in claim 2 wherein the anode, cathode, diaphragm and spacing plates are substantially of the same size.

20. A cell as claimed in claim 1 wherein the passages of each spacing plate are provided by slots cut within the thickness of the frame portion between either the openings corresponding to the anolyte compartments and the first compartment or the openings between the catholyte compartments and the second compartment.

21. A cell as claimed in claim 3 wherein the spacing plate is fabricated in polyvinylidene fluoride or polypropylene.

22. A cell as claimed in claim 1 which further comprises sealing joints or gaskets of elastomeric material corresponding in overall size and shape to the spacing plates.

23. A cell as claimed in claim 1 wherein single anodes alternate with single cathodes, with diaphragms interposed between successive anodes and cathodes.

24. A cell as claimed in claim 1 wherein pairs of anodes alternate with pairs of cathodes, with diaphragms interposed between successive pairs of anodes and cathodes.

25. A cell as claimed in claim 1 wherein each anode portion and each cathode portion has a dimension in the direction of current flow which is in the range 15 cm to 60 cm.

26. A cell as claimed in claim 23 in which each anode portion and each cathode portion of the single anode and cathodes has a dimension in the direction of current flow which is in the range 15 to 25 cm.

27. A cell as claimed in claim 24 in which each anode portion and each cathode portion of each pair of anodes has a dimension in the direction of current flow which is in the range 23 to 50 cm.

28. A cell as claimed in claim 1 wherein the distance between successive diaphragms is in the range 5 to 20 mm.

29. A cell as claimed in claim 28 wherein the distance between successive diaphragm surfaces is in the range 5 to 8 mm when using single anodes and cathodes

30. A cell as claimed in claim 28 wherein the distance between successive diaphragm surfaces is in the range 10 to 20 mm.

31. A cell as in claim 1 wherein the anode portion of the anode plate and the cathode portion of the cathode plate and the diaphragm are circular in shape.

32. A monopolar filter press electrolytic cell suitable for use in the electrolysis of aqueous alkali metal halide solution (hereinafter referred to as brine) to produce an aqueous alkali metal hydroxide solution (hereinafter referred to as cell liquor), halogen and hydrogen, which cell comprises a plurality of anode plates and cathode plates, and a hydraulically permeable diaphragm positioned between each adjacent anode plate and cathode plate, the anode plates comprising an anode portion of a film-forming metal which carries an electrocatalytically active coating, the cathode plates comprising a metallic cathode portion, characterised in that the cell comprises at least one spacing plate of a non-conducting material positioned between each anode plate and adjacent diaphragm and between each cathode plate and adjacent diaphragm, the anode plates, cathode plates and spacing plates being provided with at least two openings in the faces of the plates which, when the said plates are assembled into a filter press cell, define in combination a first compartment lengthwise of the cell and a second compartment lengthwise of the cell separated from the first compartment, the said compartments in the filter press cell being located above the anolyte and catholyte compartments of the cell defined respectively by the spaces between the anodes and diaphragms and the spaces betwee the cathodes and diaphragms, the anode portion of the anode plate and the cathode portion of the cathode plate and the diaphragm being of substantially the same shape and being of circular shape or of square or rhombus shape with the diagonals of the square or rhombus being substantially horizontal or vertical and at least one of said plate portions being in the form of louvres, the spacing plates between the anodes and adjacent diaphragm being provided with at least one passage which permits brine to pass between the first compartment and anolyte compartments and which permits halogen to be released from the anolyte compartments to the first compartment, and the spacing plates between the cathodes and adjacent diaphragms being provided with at least one passage which permits cell liquor and hydrogen to pass from the catholyte compartments to the second compartment, the cell being provided with end plates which provide end walls for the aforementioned first and second compartments, the anode plates and cathode plates being made in part of a non-conducting material so that the first and second compartments are electrically insulated from one another.

33. A cell as in claim 32 wherein the louvres are in the anode plate portion and aligned so that their longitudinal axes are parallel to one another and are inclined at 45° to the vertical so as to direct the halogen produced in an anolyte compartment towards the first compartment.

34. A cell as in claim 32 wherein the lourves are in the cathode plate portion and are aligned so that their longitudinal axes are parallel to one another and are inclined at 45° to the vertical so as to direct the hydrogen produced in a catholyte compartment towards the second compartment, the said louvres being inclined at 90° to the louvres of the anode plate.

35. A monopolar filter press electrolytic cell suitable for use in the electrolysis of aqueous alkali metal halide solution (hereinafter referred to as brine) to produce an aqueous alkali metal hydroxide solution (hereinafter referred to as cell liquor), halogen and hydrogen, which cell comprises a plurality of anode plates and cathode plates, and a hydraulically permeable diaphragm positioned between each adjacent anode plate and cathode plate, the anode plates comprising an anode portion of a film-forming metal which carries an electrocatalytically active coating, the cathode plates comprising a metallic cathode portion, characterised in that the cell comprises at least one spacing plate of a non-conducting material positioned between each anode plate and adjacent diaphragm and between each cathode plate and adjacent diaphragm, the anode plates, cathode plates and spacing plates being provided with at least two openings in the faces of the plates which, when the said plates are assembled into a filter press cell, define in combination a first compartment lengthwise of the cell and a second compartment lengthwise of the cell separated from the first compartment, the said compartments in the filter press cell being located above the anolyte and catholyte compartments of the cell defined respectively by the spaces between the anodes and diaphragms and the spaces between the cathodes and diaphragms, the anode portion of the anode plate and the cathode portion of the cathode plate and the diaphragm being of substantially the same shape and being of circular shape or of square or rhombus shape with the diagonals of the square or rhombus being substantially horizontal or vertical, the spacing plates between the anodes and adjacent diaphragms being provided with at least one passage which permits brine to pass between the first compartment and the anolyte compartments and which permits halogen to be released from the anolyte compartments to the first compartment, and the spacing plates between the cathodes and adjacent diaphragms being provided with at least one passage which permits cell liquor and hydrogen to pass from the catholyte compartments to the second compartment, each spacing plate being made of an elastomeric material and serving as a combined spacing plate and sealing joint or gasket, and the passages of the plate being in the form of a spring device incorporated into the spacing plate and comprising a pressing in the anode or cathode material for a flexible polymeric moulding, the cell being provided with end plates which provide end walls for the aforementioned first and second compartments, the anode plates and cathode plates being made in part of a non-conducting material so that the first and second compartments are electrically insulated from one another.

* * * * *